US011072169B2

(12) United States Patent
Bontrager et al.

(10) Patent No.: US 11,072,169 B2
(45) Date of Patent: Jul. 27, 2021

(54) CARD PROCESSING SYSTEM WITH DROP-ON-DEMAND PRINT HEAD AUTOMATED MAINTENANCE ROUTINES

(71) Applicant: Entrust Corporation, Shakopee, MN (US)

(72) Inventors: Kevin Bontrager, Shakopee, MN (US); Daniel Sarkinen, Shakopee, MN (US); Cory D. Wooldridge, Shakopee, MN (US); Jon Wawra, Shakopee, MN (US); Brendan Hinnenkamp, Shakopee, MN (US); Andrew Luu, Shakopee, MN (US); Brian O'Dell, Shakopee, MN (US); Kyle Johnson, Shakopee, MN (US); Randy Jordan, Shakopee, MN (US)

(73) Assignee: ENTRUST CORPORATION, Shakopee, MN (US)

( * ) Notice: Subject to any disclaimer, the term of this patent is extended or adjusted under 35 U.S.C. 154(b) by 0 days.

(21) Appl. No.: 16/409,432

(22) Filed: May 10, 2019

(65) Prior Publication Data

US 2019/0344565 A1 Nov. 14, 2019

Related U.S. Application Data

(60) Provisional application No. 62/700,522, filed on Jul. 19, 2018, provisional application No. 62/670,272, filed on May 11, 2018.

(51) Int. Cl.

| | |
|---|---|
| ***B41J 2/14*** | (2006.01) |
| ***B41J 2/21*** | (2006.01) |
| ***B41J 2/045*** | (2006.01) |

(52) U.S. Cl.
CPC ..... *B41J 2/14* (2013.01); *B41J 2/04598* (2013.01); *B41J 2/2117* (2013.01)

(58) Field of Classification Search
CPC ..... B41J 2/16505; B41J 2/16517; B41J 2/16523; B41J 2/16526; B41J 2/16532;
(Continued)

(56) References Cited

U.S. PATENT DOCUMENTS 4,825,054 A 4/1989 Rust
4,970,535 A 11/1990 Oswald et al.
(Continued)

OTHER PUBLICATIONS

IP.com search (Year: 2021).*
(Continued)

*Primary Examiner* — Lisa Solomon
(74) *Attorney, Agent, or Firm* — Hamre, Schumann, Mueller & Larson, P.C.

(57) ABSTRACT

Maintenance routines that can be used to maintain the operability of one or more DOD print heads in a card processing system. The maintenance routines can include, but are not limited to: a cover routine where a cover or cap is selectively and automatically located over the print head(s) to protect the print head(s); a shake pulse routine that energizes the nozzles of the print head(s) without causing an ejection of ink; a spit routine where the nozzles of the print head(s) are energized to eject one or more drops of ink; and a purge routine where the nozzles are not electrically energized but the pressure holding the ink in the nozzles of the print head(s) is reversed to push ink out of the nozzles.

18 Claims, 6 Drawing Sheets

(58) Field of Classification Search
CPC ..... B41J 2/1707; B41J 2002/16567; B41J 11/0015
See application file for complete search history.

(56) References Cited

U.S. PATENT DOCUMENTS

| | | | | |
|---|---|---|---|---|
| 4,995,501 | A | 2/1991 | Lundstrom | |
| 5,151,715 | A | 9/1992 | Ward et al. | |
| 5,266,781 | A | 11/1993 | Warwick | |
| 5,432,539 | A | 7/1995 | Anderson | |
| 5,574,485 | A | 11/1996 | Anderson et al. | |
| 5,617,124 | A | 4/1997 | Taylor et al. | |
| 5,706,038 | A | 1/1998 | Jackson et al. | |
| 5,790,146 | A | 8/1998 | Anderson | |
| 5,837,991 | A | 11/1998 | LaManna | |
| 5,847,727 | A | 12/1998 | VanLiew et al. | |
| 5,886,714 | A | 3/1999 | Burney et al. | |
| 5,898,445 | A | 4/1999 | Becker et al. | |
| 6,017,110 | A | 1/2000 | Jackson | |
| 6,131,817 | A | 10/2000 | Miller | |
| 6,164,751 | A | 12/2000 | Griffin et al. | |
| 6,241,337 | B1 | 6/2001 | Sharma et al. | |
| 6,244,685 | B1 | 6/2001 | Yamada et al. | |
| 6,250,736 | B1 | 6/2001 | Wojcik | |
| 6,267,464 | B1 | 7/2001 | Furlani et al. | |
| 6,273,103 | B1 | 8/2001 | Enz et al. | |
| 6,290,324 | B1 | 9/2001 | Jackson et al. | |
| 6,312,090 | B1 | 11/2001 | Griffin et al. | |
| 6,334,662 | B2 | 1/2002 | Hollands | |
| 6,343,850 | B1 | 2/2002 | Domagall | |
| 6,347,858 | B1 | 2/2002 | Faisst, Jr. et al. | |
| 6,406,122 | B1 | 6/2002 | Sharma et al. | |
| 6,431,674 | B2 * | 8/2002 | Suzuki et al. | 347/10 |
| 6,435,647 | B2 | 8/2002 | Faisst, Jr. et al. | |
| 6,435,666 | B1 | 8/2002 | Trauernicht | |
| 6,478,402 | B1 | 11/2002 | Greive | |
| 6,511,150 | B1 | 1/2003 | Yoda et al. | |
| 6,511,151 | B1 | 1/2003 | Griffin et al. | |
| 6,523,930 | B2 | 2/2003 | Griffin et al. | |
| 6,572,215 | B2 | 6/2003 | Sharma | |
| 6,598,955 | B1 | 7/2003 | Tee et al. | |
| 6,692,100 | B2 | 2/2004 | Steinfield et al. | |
| 6,695,205 | B1 | 2/2004 | Lundstrom | |
| 6,758,549 | B2 | 7/2004 | Thiessen et al. | |
| 6,783,067 | B2 | 8/2004 | Kreuter | |
| 6,886,907 | B1 | 5/2005 | Okamoto et al. | |
| 6,902,107 | B2 | 6/2005 | Shay | |
| 6,916,080 | B2 | 7/2005 | Okamoto | |
| 6,979,072 | B2 | 12/2005 | Lin | |
| 7,004,559 | B2 | 2/2006 | Aliaga | |
| 7,159,962 | B2 | 1/2007 | Wouters | |
| 7,286,257 | B1 * | 10/2007 | Morgavi | 358/1.18 |
| 7,296,875 | B2 | 11/2007 | Chiu et al. | |
| 7,350,897 | B2 | 4/2008 | Ciliberti et al. | |
| 7,398,972 | B2 | 7/2008 | Schuller | |
| 7,434,728 | B2 | 10/2008 | Paulson | |
| 7,510,261 | B2 | 3/2009 | Karppinen et al. | |
| 7,571,980 | B2 | 8/2009 | Deshon-Stepp et al. | |
| 7,722,153 | B2 | 5/2010 | Karppinen et al. | |
| 7,753,478 | B2 | 7/2010 | Hibbard et al. | |
| 7,758,152 | B2 | 7/2010 | Hibbard et al. | |
| 7,775,621 | B2 | 8/2010 | Chun | |
| 7,815,282 | B2 | 10/2010 | Hibbard et al. | |
| 7,819,500 | B2 | 10/2010 | Hibbard et al. | |
| 7,832,834 | B2 | 11/2010 | Hibbard et al. | |
| 7,874,636 | B2 | 1/2011 | Perrin et al. | |
| 7,891,759 | B2 | 2/2011 | Guhse et al. | |
| 7,891,763 | B2 | 2/2011 | Hibbard et al. | |
| 7,909,450 | B2 | 3/2011 | Yamauchi et al. | |
| 7,967,423 | B2 | 6/2011 | Katerberg | |
| 8,313,165 | B2 | 11/2012 | Hibbard et al. | |
| 8,360,551 | B2 | 1/2013 | Kagata et al. | |
| 8,888,233 | B2 | 11/2014 | Muhl et al. | |
| 8,979,244 | B2 | 3/2015 | Kritchman et al. | |
| 9,016,831 | B2 | 4/2015 | Brenner et al. | |
| 9,162,465 | B1 | 10/2015 | Tamarez Gomez | |
| 9,221,261 | B2 | 12/2015 | Love et al. | |
| 9,259,933 | B1 | 2/2016 | Fima | |
| 9,315,028 | B2 | 4/2016 | Berry et al. | |
| 9,409,401 | B2 | 8/2016 | Jefferson et al. | |
| 2007/0187870 | A1 | 8/2007 | Lundstrom | |
| 2016/0347081 | A1 | 12/2016 | Fukasawa | |
| 2017/0200074 | A1 | 7/2017 | Beech | |
| 2017/0228632 | A1 | 8/2017 | Knipp | |
| 2017/0246877 | A1 * | 8/2017 | Ishikawa et al. | B41J 2/185 |

OTHER PUBLICATIONS

International Search Report and Written Opinion documentation dated Aug. 23, 2019 for PCT patent application No. PCT/US19/31808, 12 pages.

* cited by examiner

CARD PROCESSING SYSTEM WITH DROP-ON-DEMAND PRINT HEAD AUTOMATED MAINTENANCE ROUTINES

FIELD

This disclosure relates to card processing systems that perform drop-on-demand printing on plastic cards including, but not limited to, financial (e.g., credit, debit, or the like) cards, driver's licenses, national identification cards, business identification cards, gift cards, and other plastic cards.

BACKGROUND

In drop-on-demand (DOD) printing, ink is ejected from one or more nozzles of a print head by electrically energizing select ones of the nozzles from which the ink is to be ejected. If a nozzle is not used periodically, the nozzle can become completely or partially clogged with ink or other debris preventing its operation or causing the nozzle to eject ink incorrectly.

In some DOD printing systems, a single item may be printed in what may be considered a production run or, if multiple items are sequentially printed in a production run, the printing is often identical from item to item so that the same set of nozzles are energized each time. Further, item throughput (i.e. the number of items printed per unit of time) is often not a concern in such DOD printing systems.

However, in a card processing system that employs DOD printing, the card throughput (i.e. the number of cards printed per unit of time) is an important factor and an effort is made to minimize the downtime of the card processing system for maintenance in order to maximize the card throughput. In addition, in a card processing system that employs DOD printing, the printing that is performed on the plastic cards, and therefore the nozzles that are energized, could vary from card to card within a batch print job or could vary from one batch print job to another batch print job.

SUMMARY

Maintenance routines are described herein that can be used to maintain the operability of one or more DOD print heads in a card processing system. The card processing system is used to print on plastic cards of the type that bear personalized data unique to the intended cardholder and/or which bear other card information. Examples of plastic cards can include, but are not limited to, financial (e.g., credit, debit, or the like) cards, driver's licenses, national identification cards, business identification cards, gift cards, and other plastic cards.

The maintenance routines described herein are automated and can be used individually, collectively, or in any combination thereof to help maintain the operability of the one or more DOD print heads in the card processing system. The card processing systems described herein can be any card processing systems that can process plastic cards by printing on the cards using a DOD printer having one or more DOD print heads, for example piezo-electric print heads, in combination with one or more of: reading data from and/or writing data to a magnetic stripe on the cards, programming an integrated circuit chip on the cards, emboss characters on the cards, indenting characters on the cards, laminating the cards, using a laser that performs laser processing such as laser marking on the cards, applying a topcoat to a portion of or the entire surface of the cards, checking the quality of personalization/processing applied to the cards, applying a security feature such as a holographic foil patch to the cards, and other card processing operations.

The DOD card printer used in the card processing system can have a single DOD print head or a plurality of DOD print heads. The DOD print heads can be piezo-electric print heads. The DOD printer can perform monochromatic or multi-color printing. In one example of multi-color printing, five DOD print heads, each of which has a plurality of nozzles, can be provided. Each print head can be designated to print a specific color ink, such as cyan, magenta, yellow, black and white (CMYKW). The DOD printer can print using any suitable ink used in DOD printing and that is suitable for use on the types of plastic cards described herein. For example, the ink can be an ultraviolet (UV) radiation curable ink.

The maintenance routines described herein can include, but are not limited to, the following: 1) a cover routine where a cover or cap is selectively and automatically located over the print head(s) to protect the print head(s); 2) a shake pulse routine that energizes the nozzles of the print head(s) without causing an ejection of ink from the nozzles; 3) a spit routine where the nozzles of the print head(s) are energized to eject one or more drops of ink; and 4) a purge routine where the nozzles are not electrically energized but the vacuum pressure holding the ink in the nozzles of the print head(s) is reversed to push ink out of the nozzles.

The maintenance routines described herein are especially beneficial when used with a DOD card printer in a card processing system. The card processing systems are expected to maintain a relatively high card throughput. In order to maintain such a high card throughput, it is important that the card processing system not be repeatedly shut down for maintenance. In one example, the card processing system can process cards at a rate of at least about 500 cards per hour, or at least about 1000 cards per hour, or at least about 1500 cards per hour, or at least about 2000 cards per hour, or at least about 2500 cards per hour.

In addition, the card processing system sequentially prints on individual cards one after the other. The printing on each individual card will be referred to herein as an individual card print job or similar. In addition, a plurality of the cards can be printed in one continuous production run which will be referred to herein as a batch card print job or similar. In some embodiments, the printing that is performed during each individual card print job can, and often does, vary from card to card. For example, each card can be printed with the name and/or the account number of the respective intended cardholder. Since the intended cardholder of each card is different and each card has a unique account number, the printing that is performed on each card would differ. In some embodiments, within a single batch print job, the printing on each plastic card could be the same. However, the card processing system may be required to perform multiple batch print jobs in a relatively short time period (for example 1-2 hours), with each batch print job requiring different printing on the cards in each batch print job. Alternatively, in other embodiments, the printing on some or all of the plastic cards in a single batch print job could be different.

The differences in printing from card to card, or from batch print job to batch print job, means that some of the nozzles of the DOD print head of the DOD printer may not be used frequently or at all for a time period, yet those nozzles must be maintained ready for use for the next card or for the next batch print job without shutting down the card processing system (or shutting down the DOD printer) as a shut-down for maintenance would reduce the card throughput. In one non-limiting embodiment, some or all of the maintenance routines described herein are employed with relatively small batch print jobs, for example less than 1500 cards, or less than 1000 cards, or less than 500.

In one method described herein, a drop-on-demand print head in a drop-on-demand printer in a card processing system is automatically maintained. The drop-on-demand printer is configured to print on plastic cards in the card processing system. The method includes automatically performing one or more of the following routines on the drop-on-demand print head:

a) a shake pulse routine at a first frequency;

b) a spit routine at a second frequency that is less than the first frequency; and c) a purge routine.

In another described embodiment, a method of printing on plastic cards in a drop-on-demand printer can be implemented where the drop-on-demand printer has a drop-on-demand print head. The method can include printing on a first plastic card using the drop-on-demand print head, where the first plastic card includes at least one of a magnetic stripe and an integrated circuit chip. After printing on the first plastic card, a shake pulse routine can be applied to the drop-on-demand print head. After applying the shake pulse routine, a second plastic card can be printed on using the drop-on-demand print head, where the second plastic card includes at least one of a magnetic stripe and an integrated circuit chip. In some embodiments, the printing on the first plastic card and the second plastic card can be part of the same production run or batch print job, with the first plastic card and the second plastic card being in sequence, and the printing on the second plastic card occurring within a short time, for example 3-5 seconds or less, after the printing on the first plastic card.

In still another embodiment, a method of printing on plastic cards in a drop-on-demand printer in a card processing system can be implemented where the drop-on-demand printer has a drop-on-demand print head having a plurality of nozzles. The method can include inputting a first plastic card into the drop-on-demand printer and positioning the first plastic card relative to the drop-on-demand print head for printing. The first plastic card is then printed on using a first subset of the plurality of nozzles of the drop-on-demand print head. Within a short time period, for example 5 seconds or less, after finishing printing on the first plastic card, a second plastic card is input into the drop-on-demand printer, the second plastic card is positioned relative to the drop-on-demand print head for printing, and printing is performed on the second plastic card using a second subset of the plurality of nozzles of the drop-on-demand print head. The second subset of nozzles used to print on the second plastic card is different than the first subset of nozzles used to print on the first plastic card.

A card processing system described herein can include a card input that is configured to hold a plurality of plastic cards to be processed, and a drop-on-demand card printer downstream from the card input and receiving plastic cards that are input from the card input. The drop-on-demand card printer can include at least one drop-on-demand print head. In addition, a controller is connected to the drop-on-demand card printer and that automatically controls the operation thereof. The controller is programmed to automatically perform one or more of the following routines on the at least one drop-on-demand print head:

a) a shake pulse routine that is performed at a first frequency;

b) a spit routine that is performed at a second frequency that is less than the first frequency; and c) a purge routine.

Another embodiment of a card processing system described herein can include a card input that is configured to hold a plurality of plastic cards to be processed, and a drop-on-demand card printer downstream from the card input and receiving plastic cards that are input from the card input. The drop-on-demand card printer can include at least one drop-on-demand print head. In addition, an integrated circuit chip programming system can be disposed between the card input and the drop-on-demand card printer, where the integrated circuit chip programming system is configured to program an integrated circuit chip on the cards. A controller is connected to the drop-on-demand card printer and automatically controls the operation thereof. The controller is programmed to automatically perform one or more of the following routines on the at least one drop-on-demand print head:

a) a shake pulse routine;

b) a spit routine; and c) a purge routine.

In another embodiment described herein, a card processing system can include a card input that is configured to hold a plurality of plastic cards to be processed, and a drop-on-demand card printer downstream from the card input and receiving plastic cards that are input from the card input, the drop-on-demand card printer includes at least one drop-on-demand print head. A controller is connected to the drop-on-demand card printer and that automatically controls the operation thereof. The controller is programmed to automatically perform a purge routine on the at least one drop-on-demand print head, where the purge routine includes at least one step-change in pressure to or from a maximum purge pressure. In one non-limiting example, the at least one step-change in pressure can occur in under 1 second.

DRAWINGS

DETAILED DESCRIPTION

Figure 1:
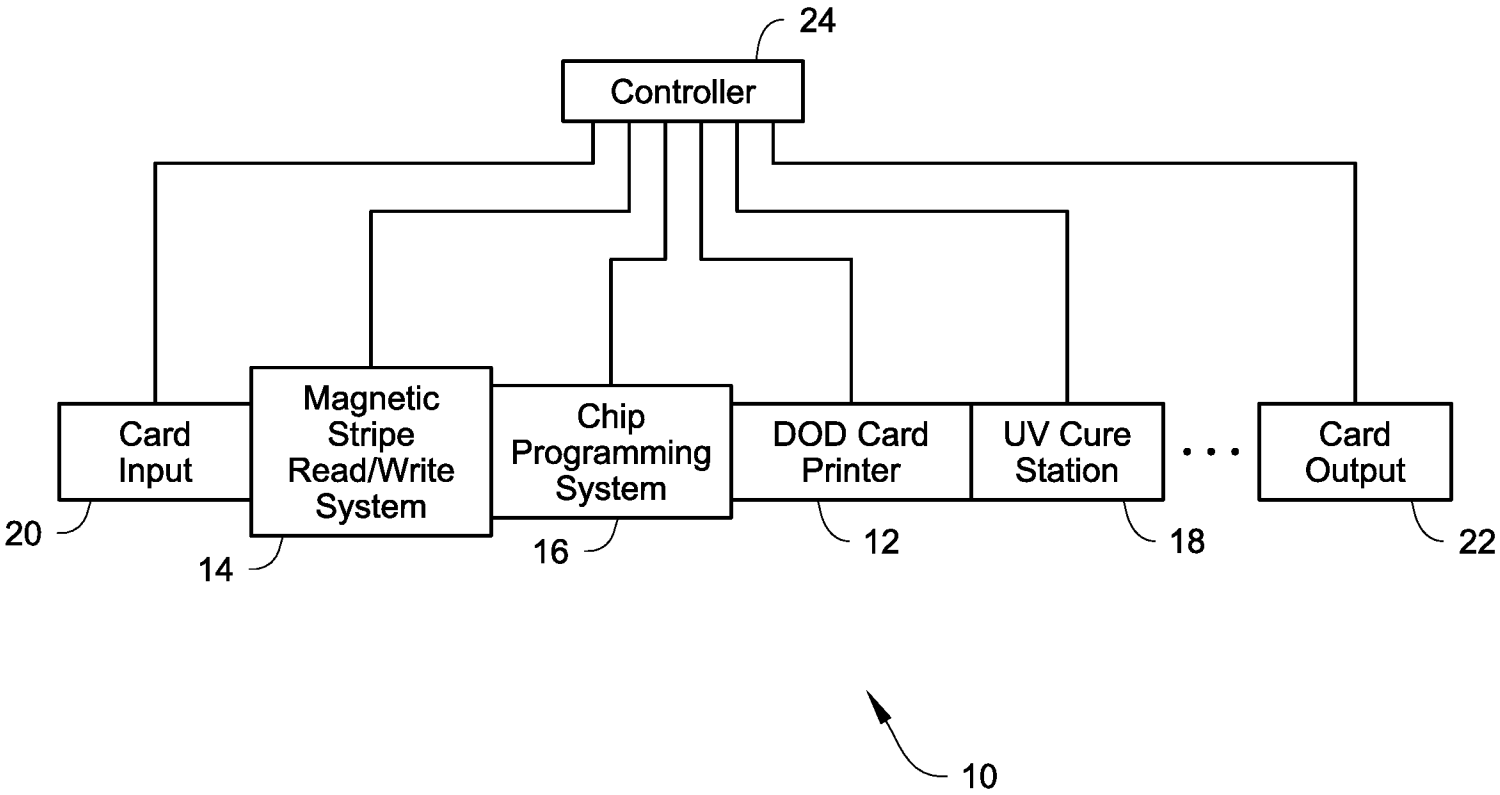
FIG. 1 illustrates a card processing system described herein.

FIG. 1 illustrates an example of a card processing system 10 described herein. The system 10 is configured to process cards by at least printing on the cards using a DOD card printer 12 included in the system 10. The system 10 can also include at least one other card processing capability in addition to the printing by the DOD card printer 12. For example, the additional card processing can include a magnetic stripe read/write system 14 that is configured to read data from and/or write data to a magnetic stripe on the cards, and/or an integrated circuit chip programming system 16 that is configured to program an integrated circuit chip on the cards. When the DOD card printer 12 prints using ultraviolet (UV) radiation curable ink, a UV cure station 18 can also be provided. The construction and operation of the systems 14, 16, 18 is well known in the art. Magnetic stripe read/write systems and integrated circuit chip programming systems are disclosed, for example, in U.S. Pat. Nos. 6,902,107 and 6,695,205, and can be found in the MX family of central issuance systems available from Entrust Datacard Corporation of Shakopee, Minn. An example of a UV radiation applicator in a card printing system is the Persomaster card personalization system available from Atlantic Zeiser GmbH of Emmingen, Germany.

The cards to be processed as described herein include, but are not limited to, plastic cards which bear personalized data unique to the intended cardholder and/or which bear other card information. Examples of plastic cards can include, but are not limited to, financial (e.g., credit, debit, or the like) cards, driver's licenses, national identification cards, business identification cards, gift cards, and other plastic cards.

In the system 10 illustrated in FIG. 1, a card input 20 is provided that is configured to hold a plurality of cards waiting to be processed. Cards are fed one-by-one from the card input 20 into the rest of the system 10 where each card is individually processed. Processed cards are transported into a card output 22 that is configured to hold a plurality of the processed cards.

Operation of the various systems 12, 14, 16, 18, 20, 22 is controlled by one or more controllers 24. Alternatively, each one of the system 12, 14, 16, 18, 20, 22, or select ones of the systems 12, 14, 16, 18, 20, 22 can have its own dedicated controller.

The cards can be transported through the card processing system 10 using any suitable mechanical card transport mechanism(s) that are well known in the art. Examples of card transport mechanisms that could be used are known in the art and include, but are not limited to, transport rollers, transport belts (with tabs and/or without tabs), vacuum transport mechanisms, transport carriages, and the like and combinations thereof. Card transport mechanisms are well known in the art including those disclosed in U.S. Pat. Nos. 6,902,107, 5,837,991, 6,131,817, and 4,995,501 and U.S. Published Application No. 2007/0187870, each of which is incorporated herein by reference in its entirety. A person of ordinary skill in the art would readily understand the type(s) of card transport mechanisms that could be used, as well as the construction and operation of such card transport mechanisms.

The card processing system 10 illustrated in FIG. 1 is a type of system that can be referred to as a central issuance card processing system. In a central issuance card processing system, the card input 20 and the card output 22 are generally at opposite ends of the system 10 with the card processing mechanisms, such as the systems 12, 14, 16, 18 in FIG. 1, between the card input 20 and the card output 22. A central issuance card processing system is typically designed for large volume batch processing of cards, often employing multiple processing stations or modules to process multiple cards at the same time to reduce the overall per card processing time. Examples of central issuance card processing systems include the MX family of central issuance systems available from Entrust Datacard Corporation of Shakopee, Minn. Other examples of central issuance systems are disclosed in U.S. Pat. Nos. 4,825,054, 5,266,781, 6,783,067, and 6,902,107, all of which are incorporated herein by reference in their entirety. In one example, the card processing system 10 (and the systems 12, 14, 16, 18 therein) can process cards at a rate of at least about 500 cards per hour, or at least about 1000 cards per hour, or at least about 1500 cards per hour, or at least about 2000 cards per hour, or at least about 2500 cards per hour.

In FIG. 1, the systems 12, 14, 16, 18 are downstream of the card input 20 and between the card input 20 and the card output 22. The sequence or arrangement of the systems 12, 14, 16, 18 relative to one another and relative to the card input 20 can be varied from the sequence that is illustrated in FIG. 1.

The system 10 may include additional card processing systems not illustrated in FIG. 1, which are well known in the art of card processing and which may also be located between the card input 20 and the card output 22. For example, the system 10 may include a card embossing system that is configured to emboss characters on the cards; an indenting system that is configured to indent characters on the cards; a laminator system that is configured to apply a laminate to the cards; a laser system that uses a laser to perform laser processing such as laser marking on the cards; a topcoat station that is configured to apply a topcoat to a portion of or the entire surface of the cards; a quality control station that is configured to check the quality of personalization/processing applied to the cards; a security station that is configured to apply a security feature such as a holographic foil patch to the cards; and other card processing operations. The additional card processing systems may be located anywhere in the system 10, such as between the UV cure station 18 and the card output 22.

Figure 2:
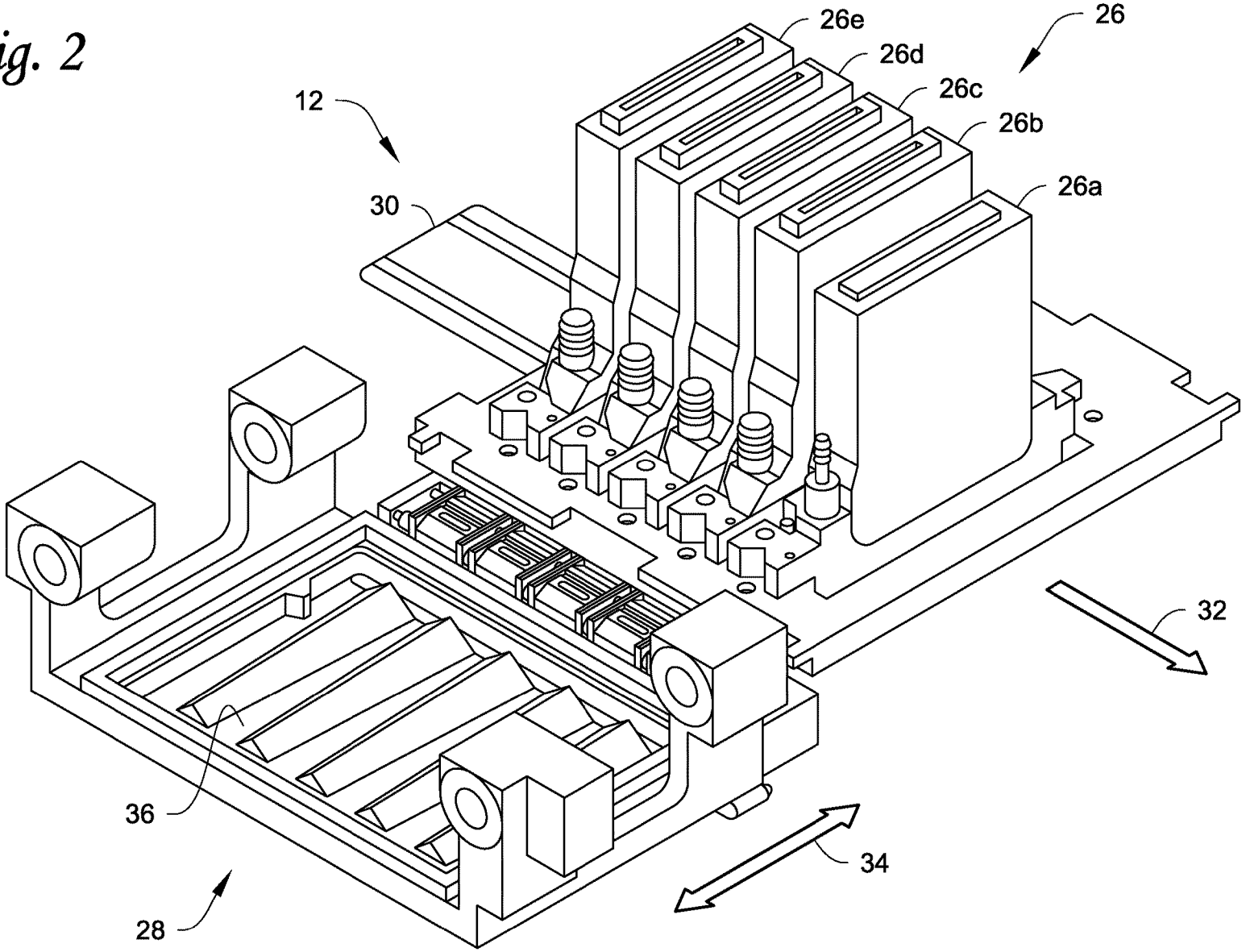
FIG. 2 illustrates select components of a DOD card printer of the card processing system of FIG. 1.

FIG. 2 illustrates select components of the DOD card printer 12. The DOD card printer 12 includes at least one DOD print head 26 and an automated covering cap 28 that is configured to be movable between a covering position (FIG. 4) over the DOD print head(s) 26 and a non-covering position (FIG. 2). The printing performed by the DOD card printer 12 can be monochromatic or multi-color. FIG. 2 shows five DOD print heads 26*a-e* arranged side-by-side to sequentially print onto a surface of a card 30 as the card 30 is transported past the print heads 26*a-e*, for example underneath the print heads 26*a-e*, in the direction of the arrow 32. However, a smaller number of the DOD print heads 26, including one of the DOD print heads 26, or a larger number of the DOD print heads 26, can be used.

The DOD print heads 26*a-e* can print using any suitable ink or coating used in DOD printing and that is suitable for use on the types of cards described herein. For example, the ink can be a UV radiation curable ink, a heat curable ink that can be cured by applying heat to the heat curable ink, or other ink or materials that can be deposited by DOD print heads. In the case of the five DOD print heads 26*a-e*, each DOD print head can print a specific color ink. For example, the DOD print head 26*e* can print cyan colored ink, the DOD print head 26*d* can print magenta colored ink, the DOD print head 26*c* can print yellow colored ink, the DOD print head 26*b* can print black ink, and the DOD print head 26*a* can print white ink. An example of a DOD printer that prints using UV radiation curable ink in a card printing system is the Persomaster card personalization system available from Atlantic Zeiser GmbH of Emmingen, Germany.

The DOD print heads 26*a-e* can be identical in construction to one another, and identical in construction to conventional DOD print heads that are well known in the art. However, the construction of the print heads 26*a-e* can differ from one another, for example the print head 26*a* for the white ink may be different than the print heads 26*b-e* for the black, yellow, magenta, cyan inks. In general, each one of the DOD print heads 26*a-e* includes a bottom surface that faces downward toward the card 30 to be printed on. A nozzle plate, through which ink is ejected, is provided on a portion of the bottom surface. The nozzle plate includes a plurality of openings therein, each opening being associated with a nozzle of the print head from which ink is ejected. The print heads 26*a-e* can be piezo-electric print heads which require electrical energy to energize the print heads and dispense ink. The general mechanical construction and operation of piezo-electric print heads is well-known in the art.

Figure 3:
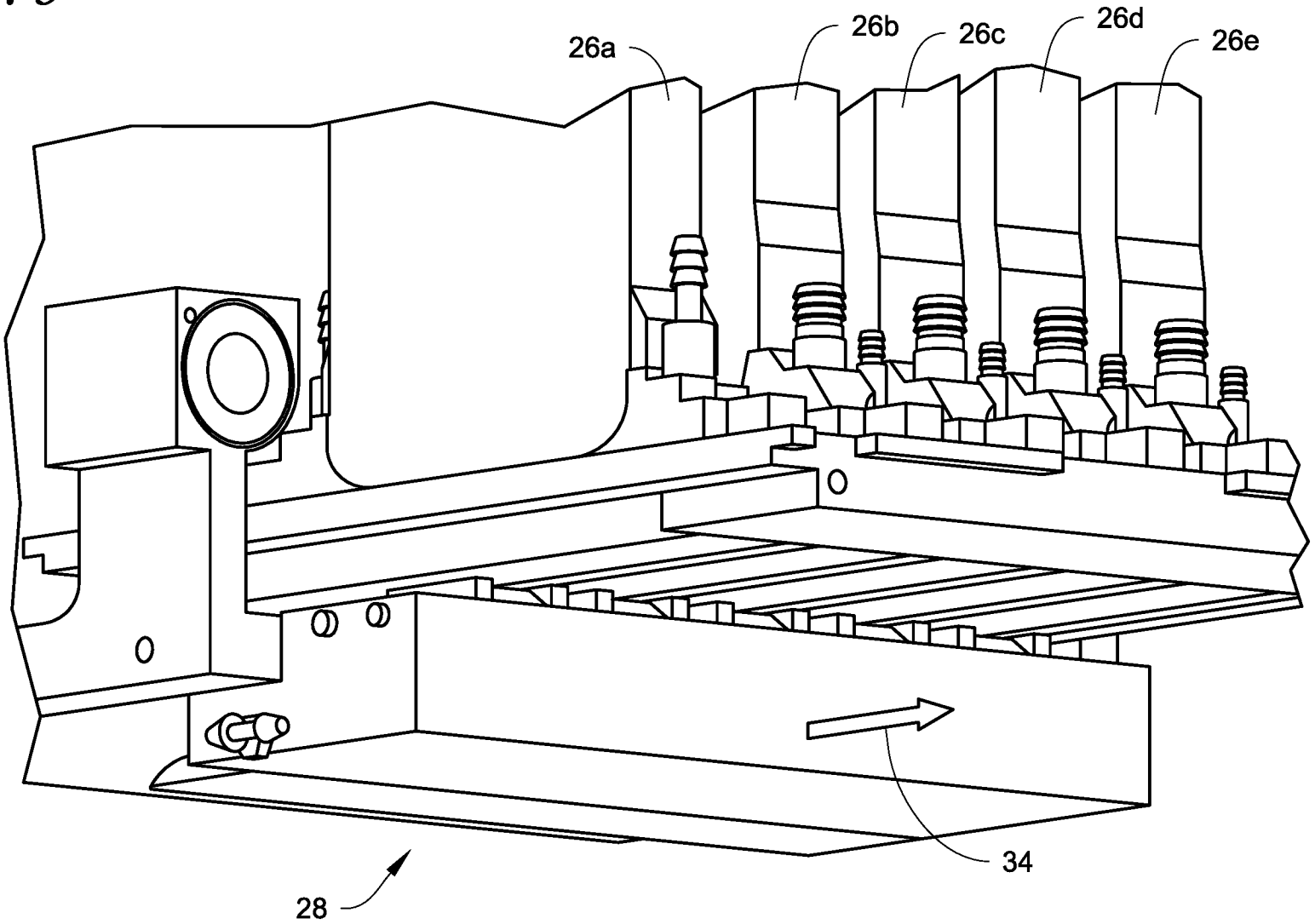
FIG. 3 illustrates the movement of the cap of the DOD card printer toward a covering position over the DOD print heads.
Figure 4:
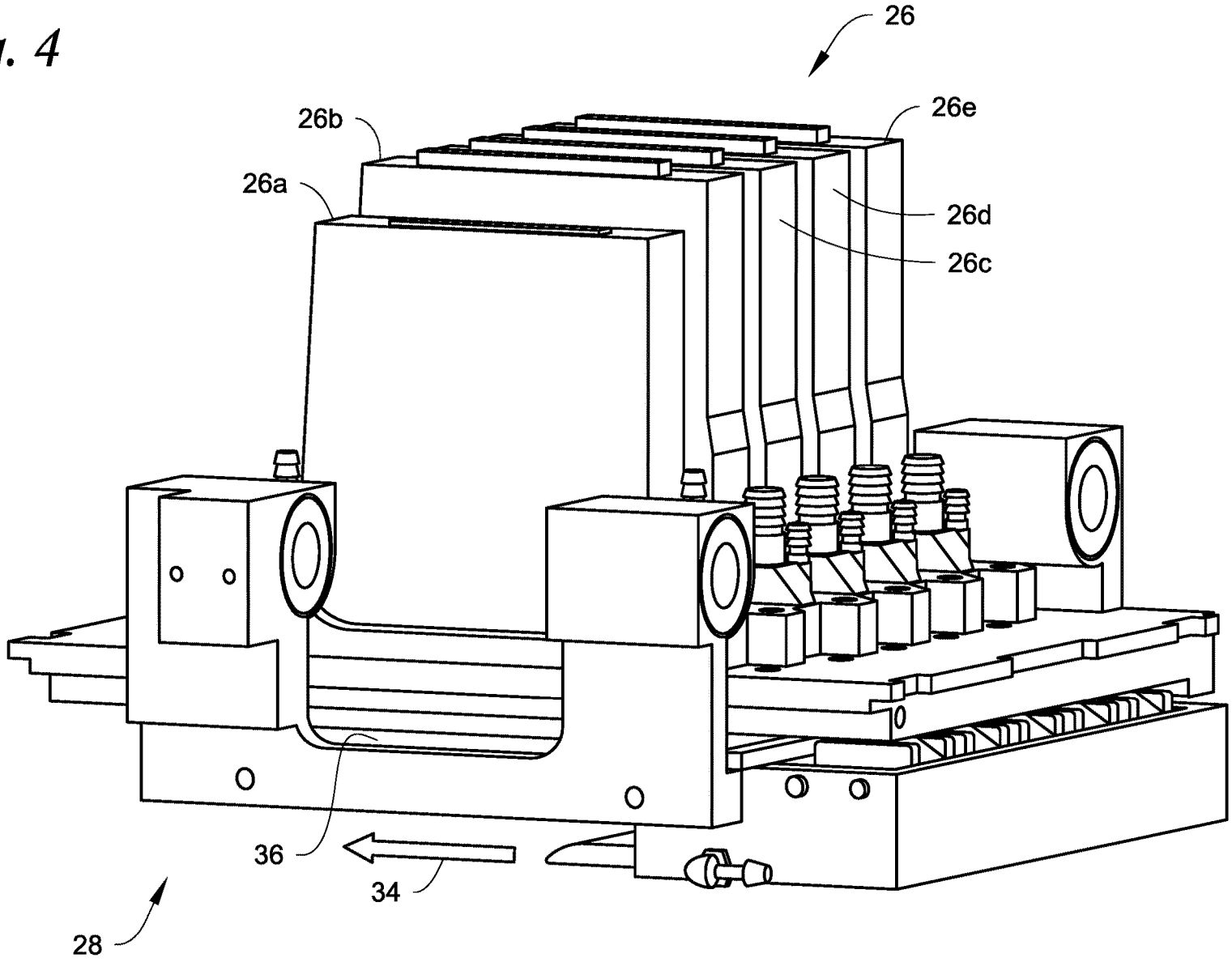
FIG. 4 illustrates the movement of the cap of the DOD card printer from a covering position toward a non-covering position.

Referring to FIGS. 2-4, the covering cap 28 can have any configuration that is capable of moving between the covering position (FIG. 4) over the DOD print head(s) 26 and a non-covering position (FIG. 2) to perform the functions of the covering cap 28 described herein. The cap 28 is selectively movable from the non-covering position of FIG. 2 to the covering position of FIG. 4 below the print heads 26 under control of the controller 24. The cap 28 has multiple functions. One function is to protect the print heads 26 from physical damage when the DOD card printer 12 is idle, i.e. not in operation, whereby the cap 28 is moved to the covering position. By keeping the print heads 26 covered, inadvertent contact with the print heads 26 while the DOD card printer 12 is idle is prevented. In addition, when UV radiation curable ink is used, the cap 28 also blocks UV light from reaching the print heads 26 that could cause ink on the surface of the nozzle plates to harden and negatively affect the operability of the nozzles. The cap 28 also provides a safe path for draining ink from the print heads 26 allowing easier servicing of the print heads 26. Finally, the cap 28 provides a location to spit and purge ink during the spit and purge routines (described further below) without endangering the mechanics of the DOD card printer 12 or of the system 10.

In the example illustrated in FIG. 2, the cap 28 is movable underneath the DOD print heads 26 back and forth in the direction of the arrow 34 (generally perpendicular to the transport direction 32 of the card 30) relative to the print heads 26. The cap 28 can be actuated from the non-covering position of FIG. 2 in the direction of the arrow 34 toward and underneath the DOD print heads 26 to the covering position of FIG. 4, and thereafter back in the direction of the arrow 34 back to the non-covering position of FIG. 2. The cap 28 defines a drip tray 36 that provides an area for ink and other debris to be collected when draining the ink and during the spit and purge routines (described further below). The drip tray 36 has an area that is large enough to encompass at least the total area of the nozzle plates of the print heads 26.

Figure 5:
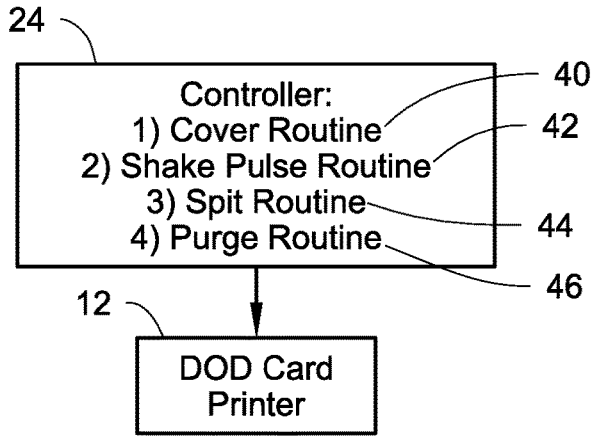
FIG. 5 illustrates various maintenance routines of the controller used on the DOD card printer.

Referring to FIG. 5, the controller 24 performs various automatic maintenance routines on the DOD card printer 12. The maintenance routines can include, but are not limited to, the following: a cover routine 40; a shake pulse routine 42; a spit routine 44; and a purge routine 46. The routines 40, 42, 44, 46 can be performed individually, collectively, or in any combination thereof to help maintain the operability of the DOD print heads 26, reduce downtime of the card processing system 10, and permit the DOD card printer 12 to accommodate the differences in printing from card to card or from batch print job to batch print job, thereby maintaining the card throughput of the card processing system 10.

The cover routine 40 selectively positions the cap 28 relative to the print heads 26 from the non-covering position of FIG. 2 to the covering position of FIG. 4 below the print heads 26 under control of the controller 24. For example, when the DOD card printer 12 is idle, the cover routine 40 moves the cap 28 to the covering position to protect the print heads 26 from physical damage. By keeping the print heads 26 covered, inadvertent contact with the print heads 26 while the DOD card printer 12 is idle is prevented. In addition, when UV radiation curable ink is used, the cover routine moves the cap 28 to the covering position so as to block UV light from reaching the print heads 26 that could cause ink on the surface of the nozzle plates to harden and negatively affect the operability of the nozzles. In addition, the cover routine 40 moves the cap 28 so that the drip tray 36 is positioned under the print heads 26 to collect draining ink from the print heads 26 during servicing of the print heads 26. In addition, the cover routine 40 moves the cap 28 so that the drip tray 36 is positioned under the print heads 26 to provide a location to spit and purge ink during the spit and purge routines 44, 46 described further below. When the cap 28 is not required, the cover routine 40 moves the cap 28 to the non-covering position shown in FIG. 2 to permit printing.

The shake pulse routine 42 sends electrical pulses to the nozzles of the print heads 26 to electrically energize the nozzles without causing an ejection of ink. The nozzles can be energized almost (but not fully) to the point of ejecting a drop. The electrical energization of the nozzles caused by the shake pulse routine 42 provides agitation of the ink in the nozzles of the print heads 26 without ejecting ink, thereby avoiding the cost of expending ink. Since ink is not ejected, the shake pulse routine 42 can be performed while the cap 28 is at the non-covering position. The electrical pulses of the shake pulse routine 42 can be sent to the print heads 26 at a desired frequency. For example, the electrical pulses of the shake pulse routine 42 can be sent to the print heads 26 at a rate of up to once per second, or at a rate of once per second. The electrical pulses can be sent to each one of the print heads 26 at the same time or concurrently, or the electrical pulses can be sent to the print heads 26 at different times or non-concurrently.

The shake pulse routine 42 can be conducted while the DOD card printer 12 is in operation. However, the shake pulse routine 42 is not conducted during actual printing or use of a print head 26 (in other words, the shake pulse routine 42 is not performed while any of the nozzles of the print head are ejecting ink). For example, the shake pulse routine can be applied between printing on sequential, adjacent cards (in other words, a first card is printed on, followed by conducting the shake pulse routine, followed by printing on a second card in sequence immediately following the first card, etc.) In another embodiment, the shake pulse routine can be performed after printing on a predetermined number (for example two, three, four, etc.) of cards (in other words, two/three/four/etc. sequential cards can be printed on, followed by conducting the shake pulse routine, followed by printing on the next two/three/four/etc. sequential cards, etc.). In another embodiment, rather than conducting the shake pulse routine based on number of cards printed on, the shake pulse routine can be conducted based on a specific, predetermined timing sequence during a batch print job. For example, at least one shake pulse routine can be conducted about every 1 second, or about every 2 seconds, or about every 4 seconds, or about every 8 seconds, etc. during a batch print job. In still another embodiment, the shake pulse routine 42 can also be conducted, for example based on a specific, predetermined timing sequence, while the DOD card printer 12 is idle.

The spit routine 44 sends electrical pulses to the print heads 26 to electrically energize the nozzles of the print head(s) to eject one or more drops of ink from the nozzles. The spit routine 44 is similar to the physical operation that occurs during printing when a particular nozzle is energized to eject a single drop. The spit routine 44 is especially useful when UV radiation curable ink is used, whereby the spit routine 44 is used to eject ink out of the nozzles that could potentially have begun the curing process. This helps to prevent clogging of the nozzles. The spit routine 44 can be at any desired frequency. For example, the controller 24 can cause the DOD card printer 12 to perform the spit routine 44 at the beginning of each batch print job to ensure that fresh ink is being used for printing in that batch print job. In addition, the controller 24 can cause the DOD card printer 12 to perform the spit routine 44 at a user configurable interval while the DOD card printer 12 is idle. In the spit routine 44, since ink is ejected from the nozzles, the cap 28 is moved to the covering position of FIG. 4 prior to the spit routine 44 so that the ejected ink is collected in the drip tray 36 of the cap 28.

In the purge routine 46, the nozzles of the print heads 26 are not electrically energized. Instead, the vacuum pressure holding the ink in the nozzles of the print head 26 is reversed to push ink out of the nozzles. The purge routine 46 forcefully ejects ink that may have started to clog the nozzles and ensures that there is a proper ink supply reaching each nozzle. The purge routine 46 also evacuates any air or particles that may have entered the nozzles. In the purge routine 46, since ink is ejected from the nozzles, the cap 28 is moved to the covering position of FIG. 4 prior to the purge routine 46 so that the ejected ink is collected in the drip tray 36 of the cap 28. The purge routine 46 is typically implemented on the DOD card printer 12 at a longer time frame, for example at the beginning of a day prior to beginning any printing operations, or once every predetermined number of hours (such as once every 12 hours), or once every 2 or 3 days, or once a week, or the like.

Figure 6:
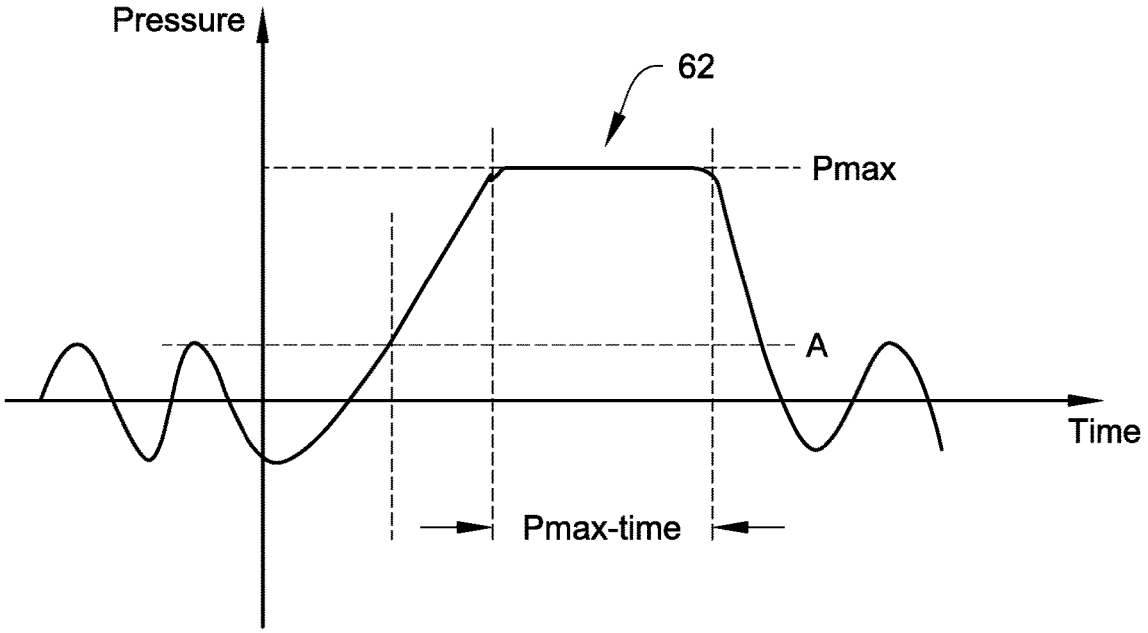
Fig. 6 Prior Art
FIG. 6 illustrates a conventional pressure variation on the ink in the nozzles of the print heads during normal operation and during a conventional purge routine using a ramp up of pressure.
Figure 7:
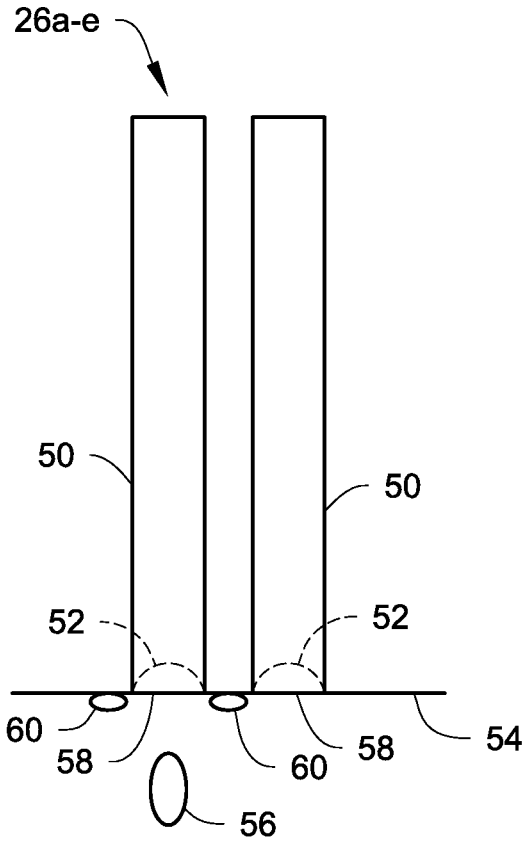
FIG. 7 is a close-up view of a pair of nozzles of a print head showing the problem of wandering ink that can occur with the conventional purge routine.

Referring to FIG. 6, the pressure variations acting on the ink within the nozzles of the print heads 26*a-e* during normal operating conditions and during a conventional purge routine is illustrated. Referring also to FIG. 7 which illustrates a small portion of one of the print heads 26*a-e*, under normal operating conditions of the DOD card printer 12, a vacuum is selectively applied to each nozzle 50 which establishes an upwards meniscus 52 (indicated by dashed line in FIG. 7) of the ink and hence a clean nozzle plate 54 is provided. The nozzle plate 54 is considered clean when there is no ink on the surface of the nozzle plate or ink below the level of the openings of the nozzles that could be applied to a card surface. During a purge routine, the vacuum is reversed to become a positive pressure that is great enough so that ink 56 is forced out through the nozzle openings 58 of the nozzles 50 of the print head 26*a-e*. Upon recovery from a purge routine, vacuum is restored and all ink in contact with the nozzle 50 and on the nozzle plate 54 adjacent to the nozzles 50 gets sucked back into the nozzles 50 through the nozzle openings 58 to restore the meniscus 52 in each nozzle 50.

However, during a conventional purge routine, ink 60 (see FIG. 7) can wander on the nozzle plate 54 where the wandering ink 60 migrates away from the nozzle opening(s) 58 and may not get sucked back into the nozzle 50 upon restoration of the vacuum. This wandering or residual ink 60 that is not sucked back into the nozzles 50 is problematic because the ink 60 will smear on the first card(s) run through the system after the purge routine is performed. Therefore, the wandering ink 60 needs to be removed from the nozzle plate 54 after a conventional purge routine, for example by performing a manual wipe of the nozzle plate 54 or other cleaning routine.

Returning to FIG. 6, a conventional purge routine 62 is illustrated where, at the start of the purge routine 62, the pressure acting on the nozzles 50 gradually ramps up starting from normal operational pressure A until the pressure reaches the intended purge pressure Pmax. The purge pressure Pmax is maintained for a period of time Pmax-time to complete the purge, and then the pressure gradually ramps down to normal operational pressure levels A. The wandering ink 60 problem is most likely to occur at intermediate pressures, i.e. those pressures between normal pressure levels A and purge pressure Pmax. However, in the conventional purge routine 62 where there is a relatively slow ramp up to purge pressure Pmax followed by a slow ramp back down to normal pressure, there is a lot of time spent at intermediate pressures, increasing the risk that ink is likely to wander.

Figure 8:
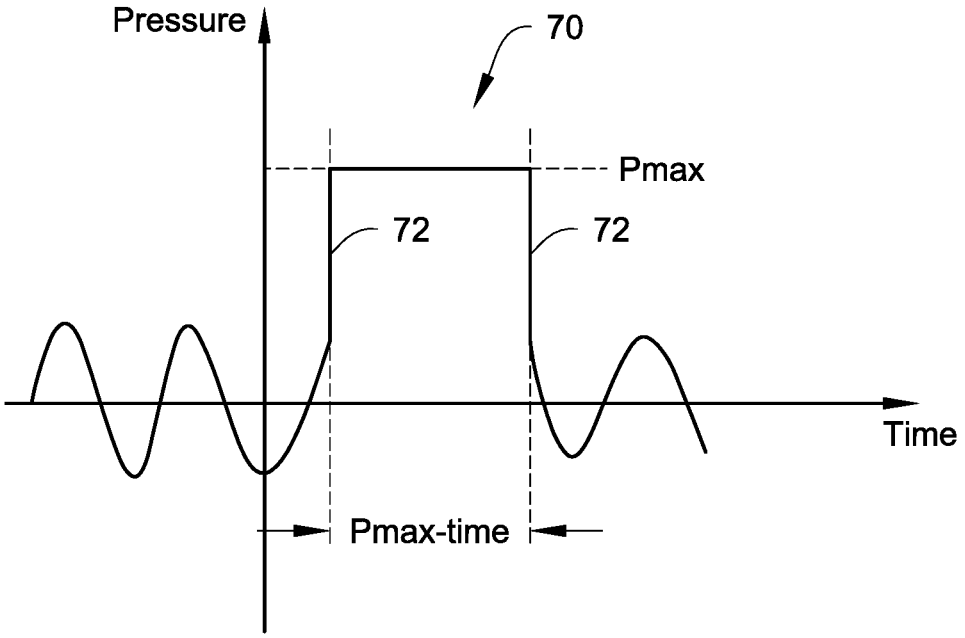
FIG. 8 illustrates pressure variation on the ink in the nozzles of the print heads during normal operation and during a purge routine described herein using step changes in pressure.

Referring to FIG. 8, the problem of wandering ink is minimized or eliminated by using a purge routine 70 that employs one or more step changes 72 in pressure. At the start of the purge routine 70, there is a quick step change 72 or increase from normal operating pressure to purge pressure Pmax (instead of a slow ramp increase like the conventional purge routine in FIG. 6). In addition, there is also quick step change 72 or decrease/return from purge pressure Pmax to normal operating pressure. The use of step changes 72 in pressure reduces the time spent at intermediate pressures, which in turn reduces or eliminates wandering ink. The end result is a clean nozzle plate 54 on a greater percentage of purge routines.

In one embodiment, each step change 72 occurs in about 1 second or less. The step changes 72 can be considered to be substantially instantaneous except for delay times inherent in sending and receiving signals, activating/deactivating pumps and valves, and other delays inherently associated with mechanical and electrical systems.

In one embodiment, the purge pressure Pmax of the purge routine 70 is greater than the purge pressure Pmax of the conventional purge routine 62. In one non-limiting example, the purge pressure Pmax of the purge routine 70 can be about 2.0 times or more greater than the purge pressure Pmax of the conventional purge routine 62. For example, if one assumes that Pmax of the conventional purge routine 62 is about 2 psi (or about 13789.5 Pa), then Pmax of the purge routine 70 can be about 4 psi (or about 55158 Pa) or greater. In another non-limiting example, the purge pressure Pmax of the purge routine 70 can be about 1.5-2.5 times greater than the purge pressure Pmax of the conventional purge routine 62. Therefore, if one again assumes that Pmax of the conventional purge routine 62 is about 2 psi (about 13789.5 Pa), then Pmax of the purge routine 70 can be about 3.0-5.0 psi (or about 20684.25 Pa to about 34473.75 Pa). In addition, the purge time Pmax-time of the purge routine 70 can be less than the purge time Pmax-time of the conventional purge routine 62.

In one embodiment, the purge routine 70 with the step changes 72 in pressure can be used on one of, or any combination of, the print heads that print the cyan, magenta, yellow, and black inks. In another embodiment, the purge routine 70 with the step changes 72 in pressure can be used on the print head that prints the white ink.

The purge routine 70 illustrated in FIG. 8 can be performed by itself (i.e. not in combination with the cover routine 40, the shake pulse routine 42, or the spit routine 44). Alternatively, the purge routine 70 illustrated in FIG. 8 can be performed with one or more of the cover routine 40, the shake pulse routine 42, or the spit routine 44. The purge routine 46 described above can be the purge routine 70 illustrated in FIG. 8, or a conventional purge routine such as the purge routine 62 illustrated in FIG. 6.

As described above, the shake pulse routine can be described as being performed at a frequency (referred to as a first frequency) while the print head is not in use (i.e. while the nozzles of the print head are not ejecting ink). In addition, the spit routine can be described as being performed at a frequency (referred to as a second frequency) that is less than the first frequency. Further, the purge routine can be described as being performed at a frequency (referred to as a third frequency) that is less than the second frequency.

The routines described herein, individually and collectively, provide a number of advantages. For example, the shake pulse routine described herein permits sequential plastic cards to be printed using different nozzles of the drop-on-demand print head. For example, a first plastic card can be input into the drop-on-demand printer, positioned relative to the drop-on-demand print head for printing, and then printed on using a first subset of the nozzles of the drop-on-demand print head. Within a short time period after finishing printing on the first plastic card, a second plastic card is input into the drop-on-demand printer, positioned relative to the drop-on-demand print head for printing, and the second plastic card is printed on using a second subset of the plurality of nozzles of the drop-on-demand print head. The second subset of nozzles used to print on the second plastic card is different than the first subset of nozzles used to print on the first plastic card. The short time period can be any time period between cards that is suitable for achieving the card processing rates described above. For example, the time period between the first and second sequential cards can be about 5 seconds or less; or about 3 seconds or less; or other time period. Because all of the nozzles are subject to the shake pulse routine, any nozzles that are not used for a print job on the first plastic card are kept ready by the shake pulse routine for use in the print job on the second plastic card. Therefore, different print jobs using different subsets of the nozzles can be performed on sequential plastic cards.

The card processing system described herein may be configured as what may be referred to as a desktop card processing system. Such a desktop card processing system can include at least a card input and a card output (which may be at opposite ends of the system or at the same end of the system), a DOD card printer that prints on the cards using UV curable ink, and a UV cure station for curing the UV curable ink applied to the card. Additional card processing systems, such as those described above, may also be included. A desktop card processing system is typically designed for relatively small scale, individual card processing. In desktop processing systems, a single card to be processed is input into the system, processed, and then output. These systems are often termed desktop machines or desktop printers because they have a relatively small footprint intended to permit the machine to reside on a desktop. Many examples of desktop machines are known, such as the SD or CD family of desktop card machines available from Entrust Datacard Corporation of Shakopee, Minn. Other examples of desktop card machines are disclosed in U.S. Pat. Nos. 7,434,728 and 7,398,972, each of which is incorporated herein by reference in its entirety.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A card processing system, comprising:

a card input that is configured to hold a plurality of plastic cards to be processed;

a drop-on-demand card printer downstream from the card input and receiving plastic cards that are input from the card input, the drop-on-demand card printer includes at least one drop-on-demand print head, and the drop-on-demand card printer is configured to print on the plastic cards with ultraviolet curable ink;

a cure station that is configured to cure ultraviolet curable ink applied to the plastic cards by the drop-on-demand card printer;

a controller connected to the drop-on-demand card printer and that automatically controls the operation thereof, the controller is programmed to control printing on the plastic cards and to automatically perform each of the following on the at least one drop-on-demand print head:

a) a shake pulse routine that is performed without causing an ejection of the ultraviolet curable ink and that is performed at a first frequency;

b) a spit routine that causes an ejection of the ultraviolet curable ink and that is performed at a second frequency that is less than the first frequency; and c) a purge routine that is performed at a third frequency that is less than the second frequency.

2. The card processing system of claim 1, wherein the card processing system processes plastic cards at a processing rate of at least about 500 cards per hour.

3. The card processing system of claim 1, wherein the drop-on-demand card printer includes a plurality of the drop-on-demand print heads, and the controller is programmed to automatically perform each of a), b) and c) on each of the drop-on-demand print heads.

4. The card processing system of claim 1, further comprising at least one of the following between the card input and the drop-on-demand card printer:

a magnetic stripe read/write system that is configured to read data from and/or write data to a magnetic stripe on the plastic cards; and an integrated circuit chip programming system that is configured to program an integrated circuit chip on the plastic cards.

5. The card processing system of claim 1, further comprising a cap that is configured to be movable between a covering position where the cap covers the at least one drop-on-demand print head and a non-covering position where the cap does not cover the at least one drop-on-demand print head; and the controller is programmed to automatically perform a cover routine that automatically controls the positioning of the cap relative to the at least one drop-on-demand print head.

6. The card processing system of claim 1, wherein the purge routine comprises at least one step-change in pressure to or from a maximum purge pressure.

7. The card processing system of claim 6, wherein the at least one step-change in pressure occurs in under 1 second.

8. A method of automatically maintaining a drop-on-demand print head in a drop-on-demand printer in a card processing system, the drop-on-demand printer printing on plastic cards in the card processing system with ultraviolet curable ink that is cured in a cure station after the ultraviolet curable ink is applied to the plastic cards, the method comprising:

automatically performing each of the following on the drop-on-demand print head:

a) a shake pulse routine that is performed without causing an ejection of the ultraviolet curable ink and performed at a first frequency;

b) a spit routine that causes an ejection of the ultraviolet curable ink and that is performed at a second frequency that is less than the first frequency; and c) a purge routine that is performed at a third frequency that is less than the second frequency.

9. The method of claim 8, wherein the drop-on-demand card printer includes a plurality of the drop-on-demand print heads, and automatically performing each of a), b) and c) on each of the drop-on-demand print heads.

10. The method of claim 8, further comprising a cap that is configured to be movable between a covering position where the cap covers the drop-on-demand print head and a non-covering position where the cap does not cover the drop-on-demand print head; and automatically performing a cover routine that automatically controls the positioning of the cap relative to the at least one drop-on-demand print head.

11. The method of claim 8, wherein the purge routine comprises at least one step-change in pressure to or from a maximum purge pressure.

12. The method of claim 11, wherein the at least one step-change in pressure occurs in under 1 second.

13. A card processing system, comprising:

a card input that is configured to hold a plurality of plastic cards to be processed;

a drop-on-demand card printer downstream from the card input and receiving plastic cards that are input from the card input, the drop-on-demand card printer includes at least one drop-on-demand print head;

a controller connected to the drop-on-demand card printer and that automatically controls the operation thereof, the controller is programmed to automatically perform a purge routine on the at least one drop-on-demand print head, wherein the purge routine comprises at least one step-change in pressure to or from a maximum purge pressure.

14. The card processing system of claim 13, wherein the controller is further programmed to automatically perform:

a) a shake pulse routine that is performed without causing an ejection of the ultraviolet curable ink and that is performed at a first frequency; and b) a spit routine that causes an ejection of the ultraviolet curable ink and that is performed at a second frequency that is less than the first frequency; and the purge routine is performed at a third frequency that is less than the second frequency.

15. The card processing system of claim 14, wherein the drop-on-demand card printer includes a plurality of the drop-on-demand print heads, and the controller is programmed to automatically perform each of the shake pulse routine, the spit routine and the purge routine on each of the drop-on-demand print heads.

16. The card processing system of claim 13, further comprising at least one of the following between the card input and the drop-on-demand card printer:

a magnetic stripe read/write system that is configured to read data from and/or write data to a magnetic stripe on the plastic cards; and an integrated circuit chip programming system that is configured to program an integrated circuit chip on the plastic cards.

17. The card processing system of claim 13, further comprising a cap that is configured to be movable between a covering position where the cap covers the at least one drop-on-demand print head and a non-covering position where the cap does not cover the at least one drop-on-demand print head; and the controller is programmed to automatically perform a cover routine that automatically controls the positioning of the cap relative to the at least one drop-on-demand print head.

18. The card processing system of claim 13, wherein the at least one step-change in pressure occurs in under 1 second.

* * * * *